United States Patent [19]

Noelle et al.

[11] Patent Number: 5,005,253

[45] Date of Patent: Apr. 9, 1991

[54] SURFACE CLEANING APPARATUS

[76] Inventors: John A. Noelle, 408 45th St. W.; Thomas J. Noelle, 1724 81st St., NW., both of Bradenton, Fla. 34209

[21] Appl. No.: 420,581

[22] Filed: Oct. 12, 1989

[51] Int. Cl.[5] ..... E01H 1/08

[52] U.S. Cl. ..... 15/346; 15/340.4; 15/374; 239/523; 239/592

[58] Field of Search ..... 15/346, 340.4, 320, 15/345, 340.3, 349, 354, 374, 78, 82; 239/592-595, 521, 523

[56] References Cited

U.S. PATENT DOCUMENTS

| | | | |
|---|---|---|---|
| 564,013 | 7/1896 | Furnas | 15/346 |
| 1,085,120 | 1/1914 | Gibbs | 239/521 |
| 1,186,117 | 6/1916 | Moe | 239/592 |
| 1,239,373 | 9/1917 | Frazer et al. | 239/594 |
| 1,322,359 | 11/1919 | Shelly | 239/592 |
| 1,434,757 | 11/1922 | Thomas | 239/521 X |
| 1,845,740 | 2/1932 | Blaney | 15/374 |
| 1,951,316 | 3/1934 | Allen | 239/594 X |
| 2,180,269 | 11/1939 | Wisher | 239/594 |
| 2,646,012 | 7/1953 | Ingalls | 239/523 |
| 3,136,488 | 6/1964 | Petlak et al. | 239/592 X |
| 3,172,143 | 3/1965 | Yucis et al. | 15/346 |
| 3,369,760 | 2/1968 | Schaible | 239/523 |
| 3,436,788 | 4/1969 | Tamny | 15/340.3 X |
| 3,490,090 | 1/1970 | Harrison | 15/340.3 X |
| 3,605,170 | 9/1971 | Hank et al. | 15/346 |
| 4,037,667 | 7/1977 | Gonsalves et al. | 239/594 X |
| 4,099,290 | 7/1978 | Hiszpanski | 15/346 |
| 4,193,159 | 3/1980 | Beard, III | 15/340.1 |
| 4,754,521 | 7/1988 | Zoni | 15/340.4 |
| 4,807,327 | 2/1989 | Jajko et al. | 15/346 |
| 4,858,270 | 8/1989 | Boschung | 15/346 X |

FOREIGN PATENT DOCUMENTS

| | | | |
|---|---|---|---|
| 1078371 | 8/1967 | United Kingdom | 15/346 |

*Primary Examiner*—Henry J. Recla
*Assistant Examiner*—Casey Jacyna
*Attorney, Agent, or Firm*—Charles J. Prescott; Raymond H. Quist

[57] ABSTRACT

A pavement cleaning vehicle having brushes for dislodging and sweeping rearwardly debris, is provided with elongated air nozzles which direct the debris towards suction heads. The air nozzles extend angularly outward and forward from a location along the center line of the vehicle and have curved end portions which curl inward from the vehicle sides in circular arcs. Suction heads are disposed at the center of the arcs and a suction head is also disposed adjacent to the centrally located nozzle ends.

6 Claims, 3 Drawing Sheets

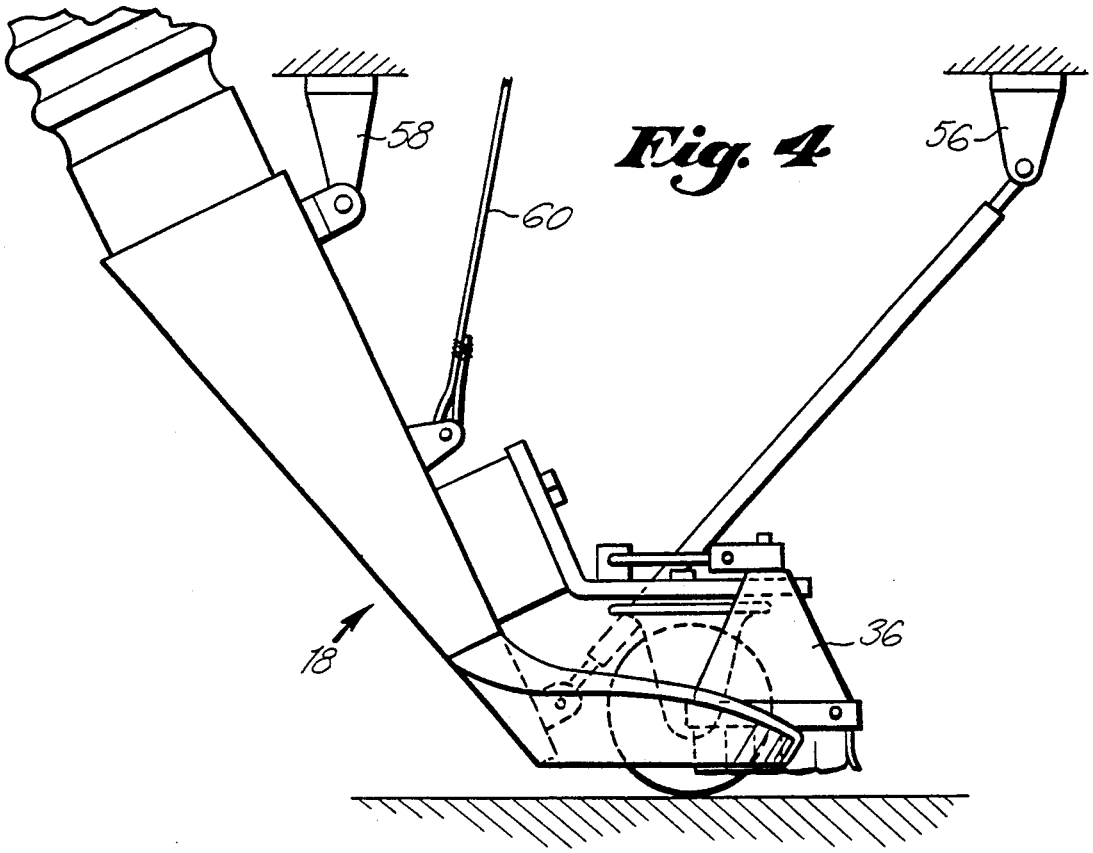
Fig. 4
Fig. 5
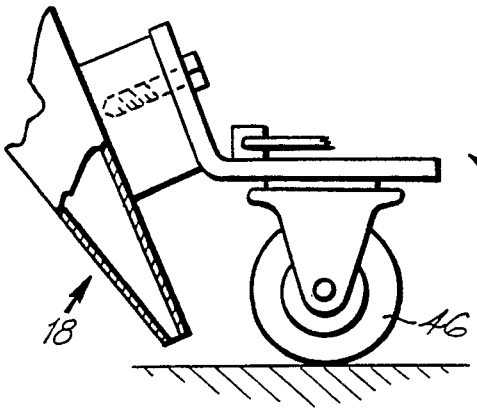
Fig. 6
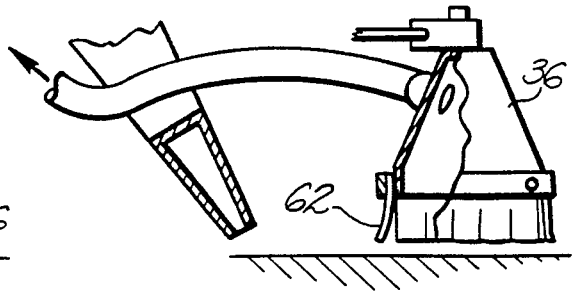

SURFACE CLEANING APPARATUS

BACKGROUND OF THE INVENTION

1. Field of the Invention

This invention relates generally apparatus for cleaning large areas such as airport runways, highways and the like, and more particularly to apparatus which uses an elongated nozzle arrangement to direct material to be vacuumed towards suction heads.

2. Description of Related Art

Jet engines can be damaged or suffer excessive wear if dirt or debris is ingested along with air. Consequently, airport runways and the tarmac should be cleaned to remove this material. In addition, the presence of rubber and petroleum products on the runways can make them slippery when wet. This deleterious material should also be removed. There is also a need to clean highways, parking lots and the like.

U.S. Pat. No. 3,161,900, Hornschuch et al., entitled "Vacuum Cleaning Head", discloses a hand held circular head having a manifold from which is discharged a high pressure air blast directed downwardly and inwardly to dislodge particles and cause them to be vacuumed up in a central hose.

U.S. Pat. No. 3,676,891, Murray et al., entitled "Vacuum Machine for Street Cleaning", discloses the use of rotating fingers within a shroud to produce air which helps dislodge leaves or the like. An independent pressure hose outside the shroud directs a stream of air against the pavement.

U.S. Pat. No. 3,872,540, Block, entitled "Sweeper Pickup Head", discloses the use of a transverse slot through which air is blasted to loosen debris and direct it to a vacuum.

U.S. Pat. No. 4,110,864, Gunnarsson, entitled "Sweeper Hood with Transverse Air Duct and Broom Compartments" discloses a hybrid sweeper having a transverse hood in which air is blown in at one end and vacuumed out at the other.

The foregoing patents are not directed to the use of elongated nozzle elements configured to blow previously dislodged debris towards a plurality of suction heads.

SUMMARY OF THE INVENTION

A surface cleaning apparatus of the type which moves forward over a surface to be cleaned and having rotating brushes for moving debris generally rearwardly, is equipped with shaped elongated nozzles which direct the debris towards associated suction heads using air currents. The nozzles extend outwardly and forwardly in a substantially straight line from a position centrally of the apparatus to positions adjacent to the sides of the apparatus where they recurve inwardly. Suction heads are located generally in the center of the recurved portion of the nozzles and centrally of the apparatus. A cleaning liquid may be applied at the brush location to aid in loosening or dissolving material on the surface to be cleaned. The apparatus may include a depending skirt at the front and sides to minimize escape of debris.

It is therefore an object of this invention to provide surface cleaning apparatus having elongated nozzles for directing debris towards suction heads positioned for optimum operation.

It is also an object of this invention to provide surface cleaning apparatus which can apply liquid cleaning solutions to enhance the ability of brushes to cleanse surfaces.

It is a further object of this invention to provide surface cleaning apparatus which will vacuum liquid cleaning solution which contains entrained or dissolved debris.

In accordance with this and other objects, which will become apparent hereafter, the instant invention will now be described with reference to the accompanying drawings.

BRIEF DESCRIPTION OF THE DRAWINGS

FIG. 4 is a side elevation detail view of the invention taken on the line 4—4 of FIG. 3.

FIG. 5 is a side elevation detail view, partially broken away, taken on the line 5—5 of FIG. 3.

FIG. 6 is a side elevation detail view, partially broken away, taken on the line 6—6 of FIG. 3.

DETAILED DESCRIPTION OF THE INVENTION

Figure 1:
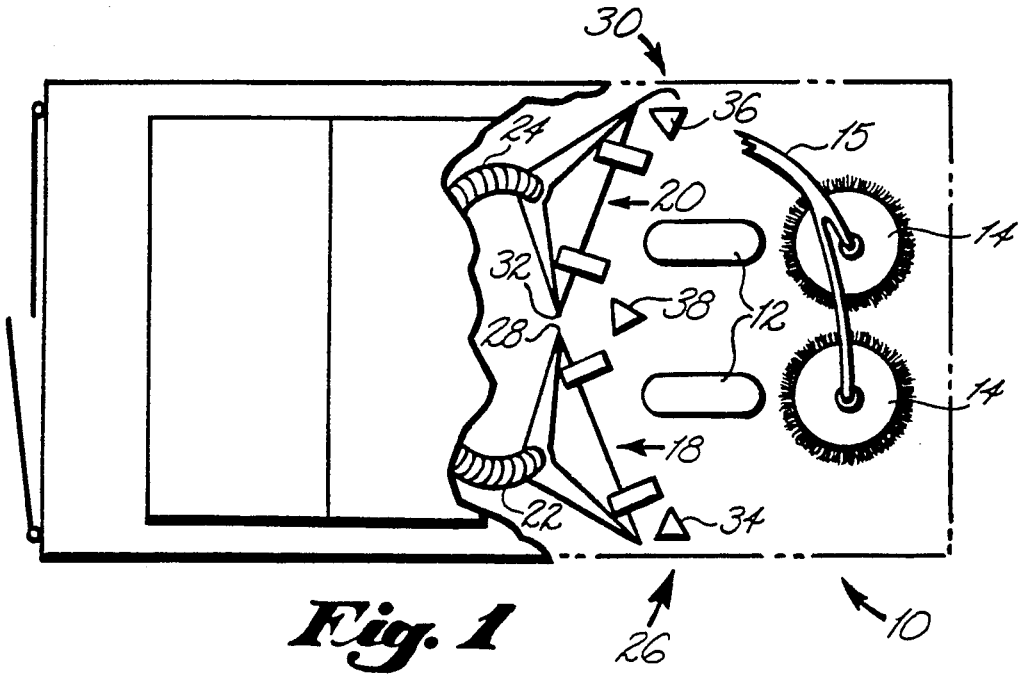
FIG. 1 is a plan view, partially broken away, to show the location of the invention on a vehicle mounted surface cleaning apparatus.
Figure 2:
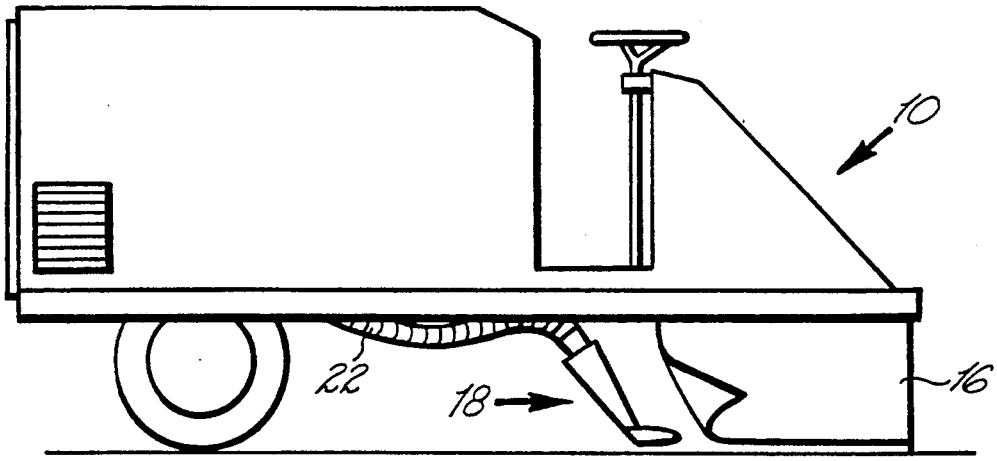
FIG. 2 is a side elevation view of the vehicle of FIG. 1.

Referring to FIG. 1, vehicle 10 has, as is conventional, front wheels 12 and rotatable brushes 14 which function to sweep debris rearwardly. More brushes may be provided and a single horizontally mounted cylindrical brush might be substituted. Hose 15 carries to the centers of brushes 14 water or another cleaning solution from a tank on vehicle 10. This liquid not only minimizes stirring up dust, it aids in the cleaning process. Where rubber or petroleum products are to be removed a solution containing a detergent is employed. As shown in FIG. 2, skirt 16 may be provided, extending across the front of vehicle 10 and part way back on the sides, to keep brushed debris, dust or liquid contained under vehicle 10.

In accordance with the invention, first and second elongated air nozzles 18 and 20 are supported to have the nozzle openings a predetermined small distance above the surface to be cleaned. Nozzle 18 has hose 22 connected to it, and nozzle 20 has hose 24 connected to it. Hoses 22 and 24 are also connected to a supply of high pressure air, not shown, such as a blower. Nozzle 18 has a curved first portion 26 disposed adjacent to one side of vehicle 10 from which it extends inwardly and rearwardly to end 28. Similarly, nozzle 20 has a curved first portion 30 disposed adjacent to the other side of vehicle 10 from which it extends inwardly and rearwardly to end 32.

Adjacent to curved first portion 26 of nozzle 18 is suction head 34. Similarly, adjacent to curved first portion 30 of nozzle 20 is suction head 36. Adjacent to ends 28 and 32 of nozzles 18 and 20, respectively, is suction head 38. The first curved portions of nozzles 18 and 20 are preferably circular arcs having centers, and suction heads 34 and 36 are preferably located at the centers of the respective circular arcs.

It has been found that debris and most of the liquid used in cleaning will be effectively directed towards the suction heads and picked up.

Figure 3:
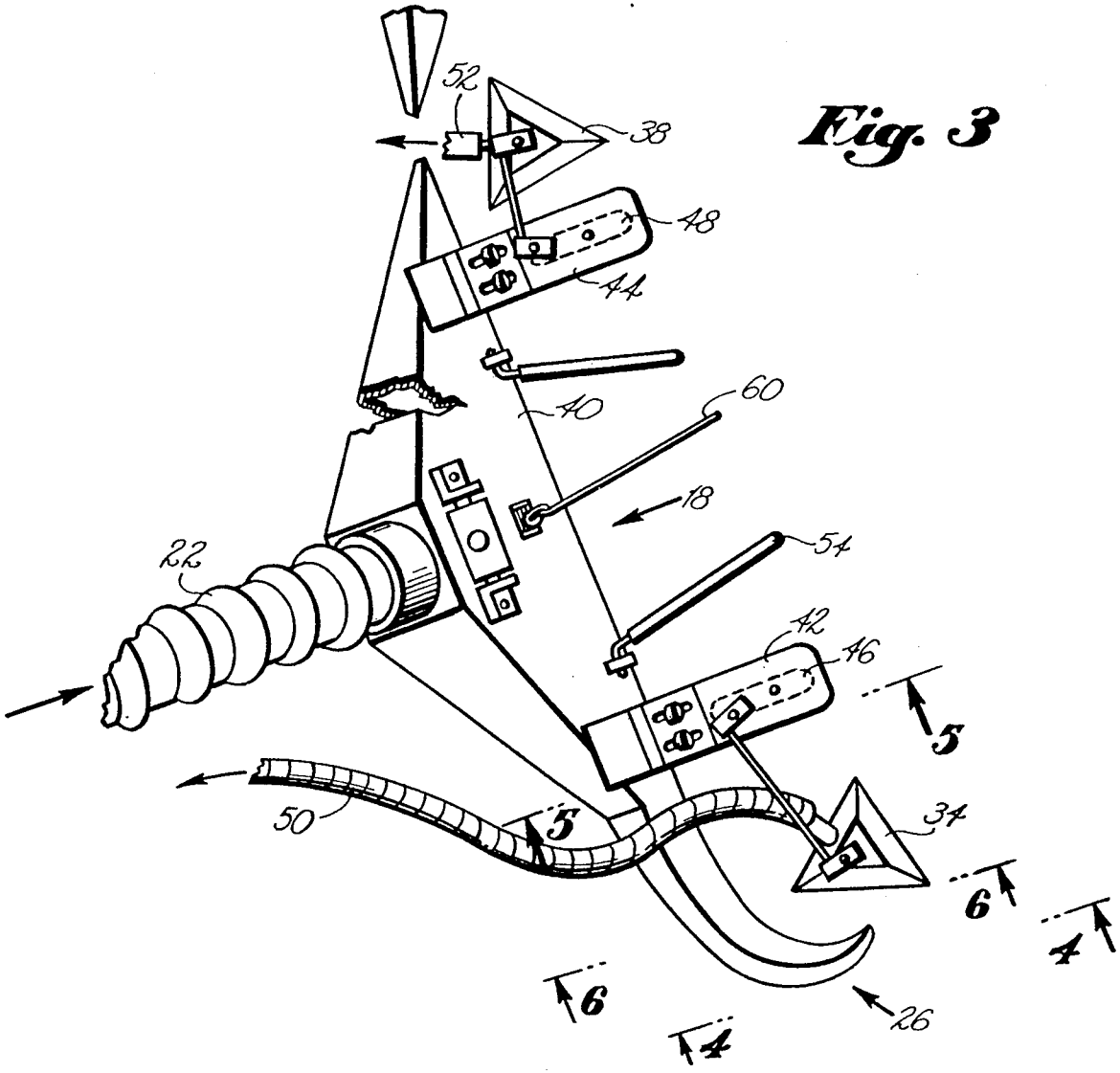
FIG. 3 is a plan view detail, showing elements of the invention, partially broken away.

Turning next to FIG. 3, nozzle 18 is shown in greater detail. Nozzle 18 tapers inwardly from top to bottom where the elongated nozzle opening is located. Secured to front plate 40 of nozzle 18 are wheel housings 42 and 44 in which are mounted for rotation wheels 46 and 48, respectively. Wheels 46 and 48 maintain the front edge of nozzle 18 at a desired predetermined height above the surface to be cleaned. Wheel housings 42 and 44 also support suction heads 34 and 38, respectively, a desired distance above the surface to be cleaned. Suction head 34 has flexible hose 50 connected thereto through which debris is carried to a suitable container on vehicle 10. Similarly, suction head 38 has flexible hose 52 connected thereto.

Turning now to FIG. 4, the taper of nozzle 18 is seen more clearly. Also shown, is support rod 54 hingedly secured to nozzle 18 at one end and having its other end secured to bracket 56 which is secured to vehicle 10. Nozzle 18 has its upper end secured to bracket 58 which is secured to vehicle 10. Line 60 is a lifting cable.

FIG. 5 shows wheel 46 and its attachment to nozzle 18, while FIG. 6 shows nozzle 36 having flexible skirt 62.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

We claim:

1. An improved debris directing and suction arrangement for use with vehicle mounted surface cleaning apparatus of the type which dispenses a liquid on the surface to be cleaned comprising:

at least a first elongated air nozzle having means for mounting said air nozzle to said vehicle such that a first end portion be disposed at one side of the vehicle and extending to a second end to be disposed towards the center of the vehicle and rearwardly with respect to said first end portion;

said first air nozzle first end portion having a horizontally curved arc configuration;

said first air nozzle having outlet means for directing an air stream generally radially inward of said arc configuration;

a first suction head having means for mounting said head to said vehicle and spaced from said first end portion of said first air nozzle and disposed adjacent to said arc, whereby air emitted from said nozzle will blow debris towards said suction head.

2. An improved debris directing and suction arrangement in accordance with claim 1 wherein:

the portion of said first air nozzle between said first end portion and said second end has a linear outlet means for directing an air stream generally inwardly orthogonally to said linear outlet means.

3. An improved debris directing and suction arrangement in accordance with claim 1 wherein:

said first air nozzle has wheels connected thereto holding said nozzle a predetermined distance above the surface to be cleaned.

4. An improved debris directing and suction arrangement in accordance with claim 1 wherein:

a second suction head disposed adjacent to said second end of said first air nozzle.

5. An improved debris directing and suction arrangement in accordance with claim 4 wherein:

a second elongated air nozzle having means for mounting said second air nozzle to said vehicle such that a first end portion be disposed at the other side of the vehicle and extending to a second end to be disposed towards the center of the vehicle and rearwardly with respect to said first end portion;

said second air nozzle first end portion having a horizontally curved arc configuration;

said second air nozzle having outlet means for directing an air stream generally radially inward of said arc configuration;

a third suction head having means for mounting said head to said vehicle and spaced from said first end portion of said second air nozzle and disposed adjacent to said arc, whereby air emitted from said second nozzle will blow debris towards said suction head.

6. An improved debris directing and suction arrangement for use with vehicle mounted surface cleaning apparatus of the type which dispenses a liquid on the surface to be cleaned comprising:

first and second elongated air nozzles having means for mounting said air nozzles to said vehicle such that a first end portion of said first air nozzle be disposed at one side of the vehicle and extending to a second end to be disposed towards the center of the vehicle and rearwardly with respect to said first end portion of said first air nozzle, and a first end portion of said second air nozzle be disposed at the other side of the vehicle and extending to a second end to be disposed towards the center of the vehicle and rearwardly with respect to said first end portion of said second air nozzle;

said first and second air nozzles first end portions having a horizontally curved arc configuration;

said first and second air nozzles having outlet means for directing air streams generally radially inward of said arc configurations;

a first suction head having means for mounting said head to said vehicle and spaced from said first end portion of said first air nozzle and disposed adjacent to said arc, whereby air emitted from said nozzle will blow debris towards said suction head;

a second suction head having means for mounting said head to said vehicle and disposed adjacent to said second end of said first air nozzle;

a third suction head having means for mounting said head to said vehicle and spaced from said first end portion of said second air nozzle and disposed adjacent to said arc, whereby air emitted from said second nozzle will blow debris towards said suction head.

* * * * *